US010046907B2

(12) United States Patent
Chitwood et al.

(10) Patent No.: US 10,046,907 B2
(45) Date of Patent: Aug. 14, 2018

(54) UNDERWATER STORAGE TANK AND FILL CONTROL MECHANISM

(71) Applicant: Safe Marine Transfer, LLC, Houston, TX (US)

(72) Inventors: James E. Chitwood, Spring, TX (US); Art J. Schroeder, Jr., Houston, TX (US)

(73) Assignee: Safe Marine Transfer, LLC, Houston, TX (US)

( * ) Notice: Subject to any disclaimer, the term of this patent is extended or adjusted under 35 U.S.C. 154(b) by 0 days.

(21) Appl. No.: 15/601,595

(22) Filed: May 22, 2017

(65) Prior Publication Data

US 2017/0259993 A1 Sep. 14, 2017

Related U.S. Application Data

(63) Continuation of application No. 15/147,246, filed on May 5, 2016, now Pat. No. 9,656,801.
(Continued)

(51) Int. Cl.
*B65D 88/78* (2006.01)
*B65D 88/02* (2006.01)
(Continued)

(52) U.S. Cl.
CPC ..... *B65D 88/78* (2013.01); *B65D 88/022* (2013.01); *B65D 88/54* (2013.01); *B65D 90/046* (2013.01); *B65D 90/32* (2013.01); *B63B 2027/165* (2013.01); *B63B 2035/448* (2013.01); *B63B 2035/4486* (2013.01); *F17C 2201/018* (2013.01); *F17C 2201/0185* (2013.01); *F17C 2201/052* (2013.01); *F17C 2201/054* (2013.01); *F17C 2203/066* (2013.01); *F17C 2205/0111* (2013.01); *F17C 2223/0123* (2013.01); *F17C 2270/0128* (2013.01)

(58) Field of Classification Search
USPC ..... 405/210; 220/565, 567.1, 567.2, 720, 220/721, 723
See application file for complete search history.

(56) References Cited

U.S. PATENT DOCUMENTS 3,753,494 A * 8/1973 Hirata ..... B65D 88/78 114/257
7,448,404 B2 * 11/2008 Samuelsen ..... B65D 88/78 137/236.1
2011/0139788 A1 * 6/2011 Li ..... B65D 90/046 220/495.05

OTHER PUBLICATIONS

International Preliminary Report on Patentability and Written Opinion issued in corresponding International Application No. PCT/US2016/030947 dated Nov. 16, 2017 (12 pages).

* cited by examiner

*Primary Examiner* — Sean D Andrish
(74) *Attorney, Agent, or Firm* — Osha Liang LLP

(57) ABSTRACT

A liquid storage tank comprising an outer container wherein the outer container is rigid and has at least one inner container disposed within the outer container. The at least one inner container contains at least one stored liquid which may be refilled from a surface vessel or host facility. The at least one inner container is flexible and pressure balanced while the volume of the outer container remains fixed, and the volume of the at least one inner containers is variable. Disposed on the outer container is a balance assembly containing an isolation valve, a check valve, and a flexible bladder. The balance assembly allows for the hydrostatic pressure to be maintained during chemical dosing and tank raising operations.

8 Claims, 5 Drawing Sheets

Related U.S. Application Data

(60) Provisional application No. 62/301,156, filed on Feb. 29, 2016, provisional application No. 62/156,952, filed on May 5, 2015.

(51) Int. Cl.

| | |
|---|---|
| ***B65D 88/54*** | (2006.01) |
| ***B65D 90/04*** | (2006.01) |
| ***B65D 90/32*** | (2006.01) |
| *B63B 35/44* | (2006.01) |
| *B63B 27/16* | (2006.01) |

UNDERWATER STORAGE TANK AND FILL CONTROL MECHANISM

CROSS-REFERENCE TO RELATED APPLICATIONS

This Application claims the benefit, pursuant to 35 U.S.C. § 119(e), of U.S. Provisional Application 62/156,952 filed on May 5, 2015, U.S. Provisional Application 62/301,156 filed on Feb. 29, 2016, and U.S. patent application Ser. No. 15/147,246 filed on May 5, 2016. These applications are herein incorporated by reference in their entirety.

BACKGROUND

Many subsea petroleum production activities require the use of chemicals or mud to be added to the active operation to properly operate. Historically, these chemical provisions have been provided through hoses, tubes or pipes bundled into "umbilicals" to supply the chemicals from nearby surface facilities to the respective points of injection. Longer offsets, remote locations and deeper water depths contribute to making umbilical solutions expensive.

Existing subsea chemical storage tanks in use today may be used for short-term single purpose use and have relatively small volumes. For example, a number of bladder style chemical storage tanks have been developed for this purpose. Existing subsea chemical storage assemblies may include single wall flexible tanks or bladders that are exposed directly to seawater, which may be contained within some cage or frame for protection and transportation. However, the sizes of these storage tanks are relatively small (hundreds of gallons). Additionally, the application use subsea is typically short term (days).

SUMMARY OF THE CLAIMED EMBODIMENTS

In one aspect, embodiments of the present disclosure relate to a liquid storage tank that includes an outer container, wherein the outer container is rigid, and at least one inner container disposed within the outer container. The at least one inner container contains at least one stored liquid, wherein the at least one inner container is flexible. The at least one inner container is pressure balanced with a barrier fluid disposed within the space between the outer container and the at least one inner container. The volume of the outer container remains fixed, and the volume of the at least one inner container is variable. Disposed on the storage tank is a balance assembly. The balance assembly fluidly connects the space between the at least one inner container and the outer container to the subsea environment and is configured to pressure balance the containers as the system is lowered to a sea floor, as the at least one inner container is emptied, and as the system is recovered from the sea floor.

In another aspect, embodiments of the present disclosure relate to a method of providing chemicals to a sea floor installation that includes providing a storage tank in a subsea environment, wherein the storage tank has an outer container and at least one inner container disposed within the outer container. The at least one inner container contains at least one chemical, wherein the at least one inner container is flexible. The at least one inner container is pressure balanced with barrier fluid disposed in the space between the outer container and the at least one inner container, and wherein the volume of the outer container remains fixed, and the volumes of the at least one inner container are variable.

The storage tank also includes a balance assembly disposed on the outside of the outer container. The balance assembly fluidly connects the space between the at least one inner container and the outer container to the subsea environment and is configured to pressure balance the containers as the system is lowered to a sea floor, as the at least one inner container is emptied, and as the system is recovered from the sea floor. During sinking operation of the storage tank in the subsea environment, the isolation valve and check valve are open to allow for the inflow of seawater. During raising operation of the storage tank from the subsea environment the isolation valve is closed.

In another aspect, according to embodiments disclosed herein is a system containing a balance assembly. The balance assembly may further contain an inlet, an assembly connection point, an isolation valve, a flexible barrier, and a check valve. The isolation valve may be located proximate the inlet, the flexible bladder may be located proximate the assembly connection point, and the check valve may be located intermediate of the isolation valve and check valve.

In another aspect, according to embodiments disclosed herein is method to retrofit an existing chemical storage tank by adding a balance assembly.

In yet other embodiments disclosed herein are methods of refilling a chemical storage tank.

Other aspects and advantages will be apparent from the following description and the appended claims.

DETAILED DESCRIPTION

Embodiments of the present disclosure relate to subsea storage tanks. For example, embodiments of the present disclosure may relate to liquid storage tanks that include a rigid outer container and at least one flexible inner container disposed within the outer container, and internal liquid. The at least one inner container may be pressure balanced with a barrier fluid, and while the volume of the outer container remains fixed, the volume of the at least one inner container is variable. Additionally, one or more storage tanks may be disposed on, or take the form of, a shuttle which may be towed to the installation location, and installed on the seafloor.

As described herein, storage tanks may include stored liquids in one or more flexible inner containers, as well as a fluid or mixture of fluids within the rigid outer container, such as a barrier fluid and/or seawater. Installation, use, and retrieval of these storage tanks may result in variation in the respective volumes of the liquids and fluids. Embodiments herein provide for compression and expansion of these internal fluids, collectively the stored fluid(s), barrier fluid, and seawater, during installation, use, and retrieval, without potential release to the environment. The barrier fluid, seawater, and one or more stored liquid collectively make up the internal fluid. While described with respect to liquid, it is understood that embodiments described may likewise be used for storing fluids, liquids, chemicals, slurries, and others, for example, and the terms are used interchangeably throughout.

Periodically, the storage tanks may be replenished with chemical to continue the system's intended function. Any tank system with a finite volume, when over-filled, can have undesirable results. Disclosed herein are also controls and measures designed to limit or avoid over-filling the tank while maintaining an adequate safety margin between the working volume and the tank's failure volume. Embodiments herein advantageously provide for systems and controls to aid in refilling on the sea floor or following retrieval.

Figure 1:
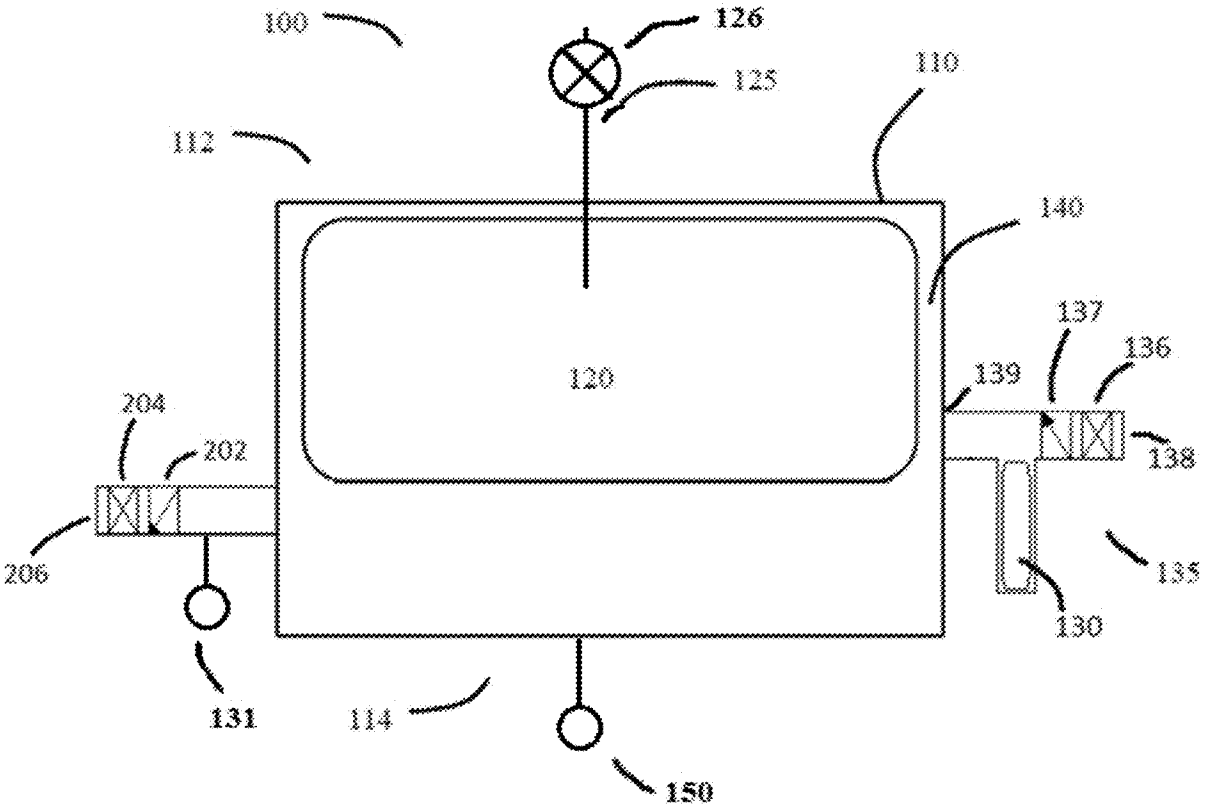
FIG. 1 shows a diagram of a storage tank according to embodiments of the present disclosure.

Referring to FIG. 1, a diagram of a liquid storage tank 100 according to embodiments of the present disclosure is shown. The storage tank 100 includes an outer container 110 and at least one inner container 120. The outer container 110 is rigid, while the inner container 120 is flexible. For example, the inner container 120 may be a bladder made of a flexible, durable material suitable for storing liquids in a subsea environment, such as polyvinyl chloride ("PVC") coated fabrics, ethylene vinyl acetate ("EVA") coated fabrics, or other polymer or elastomeric composites. The at least one inner container may be used to store at least one liquid or fluidic composition/slurry.

The storage tank may be pressure balanced. Pressure balancing of the storage tank may be used, for example, to reduce stress of the container during subsea deployment, use, and recovery operations. As the volume of the at least one inner container decreases, seawater may flow into the outer container to maintain hydrostatic pressure on the system. This kind of pressure balancing provides for a storage tank that may be reusable without the need to replace failed components, provide a pressure balanced dual barrier containment system, and reduce container construction costs.

The pressure balance may be achieved by use of a balance assembly 135, as illustrated in FIG. 1, for example. The balance assembly may be disposed on the outer container and may be fluidly connected to a space between the at least one inner container and the outer container. The balance assembly may be configured to pressure balance the containers as the system is lowered to a sea floor, as the inner container is emptied, and as the system is recovered from the sea floor.

Balance assemblies according to embodiments herein may include one or more components, such as isolation valve 136 and check valve 137 to control a flow of seawater into container 110, among other components, such as flow meters, indicators, additional valves, temperature and pressure sensors, etc. The balance assembly may also include a flexible bladder 130 intermediate the check valve 137 and the outer container 110. The balance assembly may also include an assembly inlet 138 and assembly connection point 139.

In some embodiments, the balance assembly 135 may be disposed on the outside of the outer container. In other embodiments, the balance assembly 135 may be located a separate, isolated compartment within the rigid outer container. The separate, isolated compartment will only be fluidly connected to the barrier fluid within the outer container through the balance assembly 135. The balance assembly 135 allows for the expansion of barrier fluid during storage tank recovery operations.

During a lowering operation, the balance assembly 135 may have both the isolation valve 136 and check valve 137 in the open position to allow for the inflow of seawater into the space 140 between the at least one inner container and the outer container. The inflow of seawater allows for the maintenance of the hydrostatic pressure on the container.

During chemical dosing operations, as the volume of the at least one chemical in the at least one inner container decreases, seawater from the subsea environment flows through the isolation valve 136 and check valve 137 on the balance assembly 135. This inflow of seawater mixes with the barrier fluid and maintains hydrostatic pressure on the at least one inner container.

The at least one inner container 120 may be equipped with closure valves that close and seal off when the associated inner container fully collapses, which may protect the integrity of the inner containers by not subjecting the inner containers to potentially large differential pressures. Further, the outer container 110 may act as an integral secondary or backup containment vessel that would contain any leak from the inner containers, thus creating a pressure balanced dual barrier containment system. As used herein, a "dual barrier" system refers to a system where both an inner container and an outer container have to fail before there is a tank content leak or discharge to the sea environment. Monitoring of the conditions in the space 140 between the dual barriers, such as described below, may provide an indication of required repairs for a failure of a primary barrier (an inner container). Further, integral safety features may be included in the storage tank to prevent damage to the tank system in the event the tank is emptied or overfilled.

Prior to recovery operations, the storage tank and the at least one inner container are blocked in (no flow to or from inner or outer containers), disconnected if necessary, and the isolation valve 136 is closed. During a recovery operation, the hydrostatic pressure on the container decreases as the container is raised. As the hydrostatic pressure is decreased, the internal fluid may expand. As the fluid expands, fluid between the internal and external container may flow into the flexible bladder 130 of the balance assembly 135. The flexible bladder 130 may be sized to contain at least the maximum expansion of the internal fluid. In some embodiments, the flexible bladder may be sized to contain up to 10 barrels. In other embodiments, the flexible bladder may be sized to contain up to 12 barrels. In other embodiments, the flexible bladder may be sized to contain up to 15 barrels or more, depending on the compressibility of the contained fluids.

The outer container 110 may be of any shape and made of any material. For example, the outer container 110 may be a metallic construction and integrated within a larger structure. Further, the outer container 110 may be a size that is large enough to contain at least one inner container. For example, the outer container may be large enough to contain one or more flexible inner containers that are capable of storing an amount of liquid sufficient for use for a long duration, such as between resupply operations. According to some embodiments, each of the inner containers may be sized to accommodate individual subsea operations. According to some embodiments, each of the one or more inner containers may be filled to a volume ranging up to 5,000 barrels. Further, in some embodiments, more than two flexible inner containers may be housed within the rigid outer container. For example, six or more flexible inner containers that may each be filled to a volume of up to 1,000 barrels may be housed within the rigid outer container. Other amounts of flexible inner containers, each capable of storing large amounts of liquid, may be contained within the rigid outer container. Further, each of the one or more inner containers of the present disclosure may be capable of storing equal volumes of liquid, or may be capable of storing different volumes of liquid. For example, the outer container may contain at least three inner containers, wherein a first inner container is capable of storing a larger volume of liquid than the at least two other inner containers, and wherein each of the inner containers may be connected together in series or in parallel to achieve a total working volume. It is within the scope of this disclosure that two or more inner containers may be connected together in series or in parallel to achieve a desired working volume. Further, according to some embodiments, two or more rigid outer containers may be connected together to become part of a multi-unit structure. For example, a barge having multiple separate holds may form a multi-unit structure, wherein each hold forms a rigid outer container of the present disclosure connected to each other.

Further, the volume of the outer container 110 remains fixed, and the volume of the at least one inner container 120 is variable. For example, while the stored liquid may be added or removed from the at least one inner container 120 through a controlled opening 125 (and increase or decrease the respective volume of the at least one inner container 120) and a corresponding volume of seawater may inflow through a balance assembly 135, or outflow through a controlled opening, the size and volume of the rigid outer container 110 remains fixed. A barrier fluid may be disposed within the space 140 between the outer container 110 and the at least one inner container 120. The barrier fluid may be monitored for contamination, such as contamination from a leak in one of the inner containers. For example, the barrier fluid may be monitored by disposing sensors within or fluidly connected to the space 140 between the outer container 110 and the at least one inner container 120, or barrier fluid samples may be periodically collected and analyzed on a periodic basis. According to embodiments of the present disclosure, a storage tank may include at least one sensor disposed in the space between the outer container and the at least one inner container. Sensors may be used in the storage tank, for example, to monitor contamination of the barrier fluid, as discussed above, to monitor the volumes of the at least one inner container, to monitor temperature and/or pressure conditions, or to monitor other conditions of the storage tank.

According to embodiments of the present disclosure, the active volume of fluid in the at least one inner container may be monitored by measuring the at least one inner container's relative location to either the topside 112 or bottom side 114 of the outer container 110. As used herein, "topside" may refer to the side of the referenced component that faces the seawater surface when the component is installed at the sea floor, and "bottom side" may refer to the side of the referenced component that faces the sea floor when the component is installed at the sea floor. In some embodiments, monitoring the active volume of the at least one inner container may be achieved by monitoring the inflow and outflow of seawater and the stored chemical respectively, which may help assure integrity of the storage system as well as provide an indication of the chemical dosing performed from the storage system.

At least one inner container may be filled with a liquid including at least one of chemicals, fuel, hydrocarbons, and muds. As used herein, a "stored liquid" or a "liquid" may refer to liquids other than seawater. For example, various liquids or gases that may be stored in the at least one inner container of the present disclosure may include chemicals expected to be used in subsea operation, such as methanol, glycol, diesel, oil, antiagglomerate hydrate inhibitors, low dosage hydrate inhibitors, slops, muds, completion fluids and many other possible liquids or gases. Further, liquids that may be stored in the at least one inner container may include those capable of functioning in deep sea hydrostatic pressure (up to 5,000 psi) and cold deep sea temperature (~34° F.), while also maintaining the flexibility of the at least one inner container.

Liquids stored in inner containers of the present disclosure may have a lower density than the surrounding seawater or may have a higher density than the surrounding seawater. Liquids stored in inner containers of the present disclosure may also have a lower, or higher, density than a barrier fluid disposed in the space between the outer container and the at least one inner container. For example, the density of a stored liquid that includes drilling mud may vary from a specific gravity of about 0.8 to about 2.0. For example, as shown in FIG. 1, the at least one inner container 120 may include a stored liquid that has a density lower than the seawater or barrier fluid disposed in the space between the at least one inner container and the outer container.

According to embodiments of the present disclosure, a metering system (not shown) may connect at least one inner container having a stored liquid therein to a subsea point of consumption. For example, as shown in FIG. 1, a metering system may be connected to a controlled opening 125 (e.g., which may function as an inlet or outlet, depending on whether liquid is being injected into a production system or collected) into the at least one inner container 120 containing a stored liquid, such as one or more chemicals. The metering system may be used to control the flow of the stored liquid into or out of the at least one inner container 120. In some embodiments, the pressure of a stored liquid may be elevated (with a metering pump) above hydrostatic pressure of the surrounding seawater or barrier fluid for injection into an active production system. In some embodiments, a production system may be operating below hydrostatic pressure and the sea's environmental pressure may force the stored liquid from a storage tank of the present disclosure and into the production system. Further, the rate of chemical dosing or liquid injection may be controlled. For example, in some embodiments, a stored liquid may be used sparingly in a production system and dosed at a low rate with a small metering pump, while another stored liquid, such as methanol, may be dosed in large volumes and at high rates into the production system. The piping and pumping systems used in conjunction with stored liquid injection into a production system may be sized according to the volumes and rates of the liquid being dosed.

Storage tanks of the present disclosure may have at least one inner container maintained with a stored liquid. At least one inner container of a storage tank may be refilled with a liquid by refilling the tank on the seafloor from a surface vessel or by replacing the empty tank and refilling it onshore. For example, according to embodiments of the present disclosure, a method of providing liquid (e.g., chemicals) to a sea floor installation may include providing a storage tank in a subsea environment, wherein the storage tank has an outer container and at least one flexible inner containers disposed within the outer container, wherein the volume of the outer container remains fixed, and the volume of the at least one inner container is variable. The liquid may be, for example, injected into a subsea point of consumption through a controlled opening, such as an outflow valve, in the at least one inner container, provided through a downline from the seaborne vessel to the at least one inner container of the storage tank, or refilled into the at least one inner container after the storage tank has been hoisted from the sea. Refilling operations will be discussed in more detail below.

Figure 2:
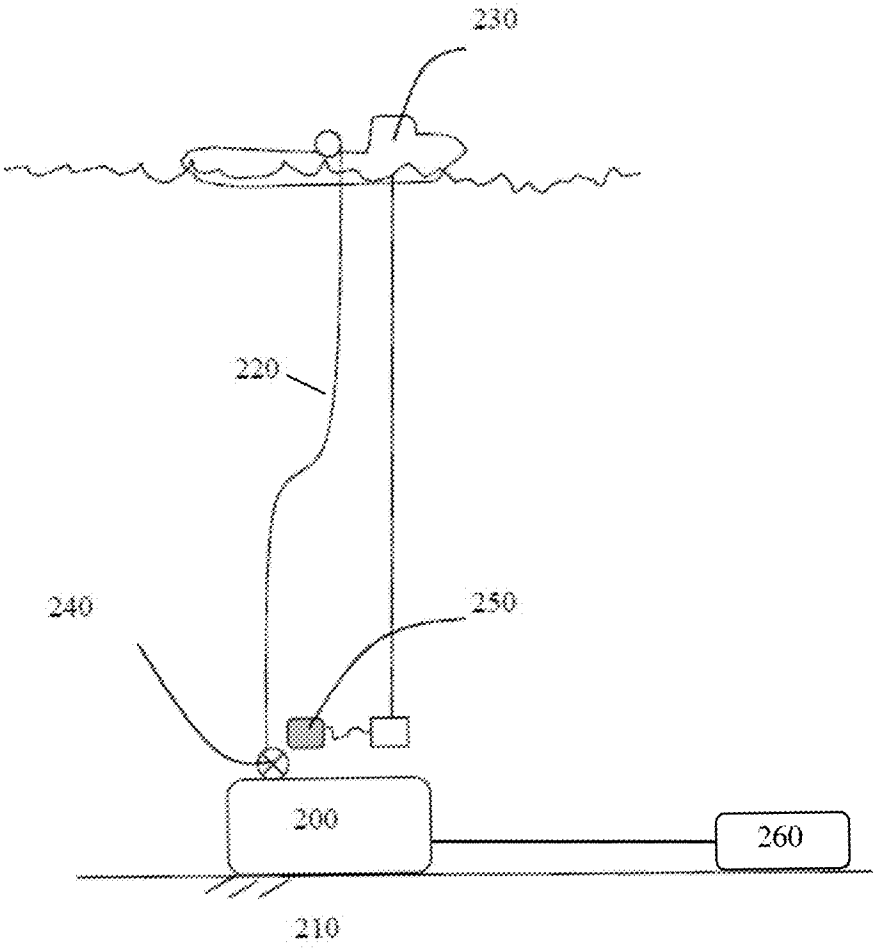
FIG. 2 shows a diagram of a storage tank installed at the seafloor according to embodiments of the present disclosure.

Referring now to FIG. 2, a storage tank 200 according to embodiments of the present disclosure is at a sea floor 210. The storage tank 200 has at least one flexible inner container (not shown), where the at least one inner container contains a stored liquid. The liquid may be injected at a subsea point of contact through an outflow valve (not shown) in the at least one inner container. As the volume of the liquid in the at least one inner container decreases, seawater from the subsea environment flows through a balance assembly (not shown), similar to that described in FIG. 1, disposed on the outer container to increase the volume of seawater in the space between the at least one inner container and the outer container. The at least one chemical may be refilled into the at least one inner container according to methods described herein. During refilling operations, isolation valve 204 (referring to FIG. 1) may be opened. When isolation valve 204 and valve 126 are in the open position, chemicals may be pumped into inner container 120 through inlet/outlet 125. This increase in volume may force some amount of seawater or barrier fluid out of the space 140, through check valve 202 and isolation valve 204, and out of riser connection point 206. Riser connection point 206 may be connected to a riser (not shown) which in turn may be connected to a storage tank on a seaborne vessel, for example. Riser connection point 206 may be provided to prevent environmental release. However, if monitoring of the barrier fluid indicates no damage to the inner container, and the barrier fluid is only seawater, expulsion of the barrier fluid to the sea may be permissible. Similar to the balance assembly 135, the riser connection valving may be internally or externally located with respect to tank 110. The riser connection valving may also be located at least partially internally or partially externally with respect to tank 110.

Referring still to FIG. 1 it is noted that a balance assembly 135 and a discharge assembly (202, 204, 206) may be combined in a single header through one connection 139 to the outer container 110. Appropriate valving and controls should be provided in such an embodiment. The use of separate connections and provision of check valves may, however, provide additional measures to prevent unwanted release or failure during raising, lowering, operating, or refilling operations. The discharge assembly may additionally include a contamination sensor 131, which will be discussed in more detail below.

Referring again to FIG. 2, a downline 220 may be provided from a seaborne vessel 230 to the at least one inner container, wherein the downline includes a refill nozzle 240 connecting the downline 220 to the storage tank 200 and a pressure control valve positioned at the refill nozzle 240. The pressure control valve may be part of the storage tank, or may be part of the downline 220. The pressure control valve may control the downline outlet pressure to a maximum differential over the ambient hydrostatic pressure from the surrounding subsea environment through the balance assembly. By controlling the downline outlet pressure to a maximum differential over the ambient hydrostatic pressure, the pressure control valve may prevent overpressurization of the storage tank during refill operations. For example, the pressure control valve may control the downline outlet pressure to a differential pressure of less than about 20 psi, and less than 10 psi in some embodiments. The downline 220 may be a riser, tubing, coiled tubing, jointed riser, or hose that may provide a fluid connection between seaborne vessel 230 and subsea storage container 200.

Referring still to FIG. 2, at least one remotely operated vehicle ("ROV") 250 may be used to perform subsea operations on the storage tank 200. As shown, an ROV 250 may be tethered to the seaborne vessel 230. The ROV 250 may be used, for example, to connect the initial injection hoses and any power and command links to the subsea production system or to connect a downline 220 to the storage tank 200 for refilling applications. In some embodiments, two or more ROVs may be used to perform subsea operations. In some embodiments, an autonomous underwater vehicle (AUV) may be used to perform subsea operations.

According to one or more embodiments disclosed herein is a pressure compensated subsea storage tank working at near hydrostatic pressure. The chemical is stored in the tank and a pump withdraws this chemical through a distribution network which delivers the chemical at injection pressure to its respective subsea points of consumption 260. As the tank's stored chemical is depleted, the tank may need to be refilled. Described below are contemplated manners in which the tanks may be refilled.

In some embodiments the tank may be recovered to the surface, returned to shore where the tank may be serviced, inspected and refilled with chemical product. Once filled, the tank could be re-installed on the seafloor, according to one or more embodiments disclosed herein, where it would again supply the stored chemical to the metering system and distribution network. For continuity of operations this refill method may be performed by swapping of one or more empty tanks with one or more full tanks.

In another method, the tank may be refilled while on the seafloor. This seafloor refill method may be performed by connecting a surface ship to the tank using a downline system, where the tank may be refilled in place on the seafloor.

If the routine chemical usage is a "batch" or intermittent treatment, then it may be possible to "trickle" or slowly refill the tank's working volume through a small flow conduit like that found in an umbilical from a host facility. In this scenario the subsea tank may function as a "day tank" or a surge tank to supply chemical during high demand events where the demand exceeds the small conduit's supply capacity.

The common risk in all three refill scenarios is over-filling the tank to the point of tank failure caused by internal pressure build-up once the tank is full of liquid. This is a potential failure mechanism due to the high chemical refill supply pressure that exceeds the tank's internal failure pressure. This failure mechanism may be approached in one or more ways as discussed below.

One possible solution is to monitor the tank's internal volume of chemical during refill to operate within a safe working volume. This may be indirectly accomplished by totalizing the chemical flow into and out of the tank. Whenever the full level of the tank is approached, the rate of filling may be slowed for greater shut-down control. Depending upon the properties of the chemical (i.e., specific gravity), another method to measure volume may be directly measuring the chemical level, and thus volume. This approach may be used when the chemical's specific gravity is not close to 1 (i.e., not similar to sea water). Another volume measurement method may be through the use of a particular tracer additive in the chemical whose presence could be directly measured within the enclosed confines of the tank.

Another possible solution is to manage the refill pressure of the chemical during refilling operations to assure a safe pressure within the capability of the tank. This pressure management may be achieved with a control valve (or pressure regulator) using the downstream pressure to control the valve. This may be accomplished by having the downstream piping sufficiently large as to not create a significant backpressure due to fluid flow.

A separate differential pressure sensor may monitor the pressure inside the storage tank compared to the external hydrostatic pressure. This sensor may be located away from the chemical inlet port to minimize the influence of small transient pressures. Should this sensor detect alarm pressures, the refill operations may go into a safety shut-down (SSD) mode of operation. Since the chemical supply line or riser may be long, the SSD valve may be located in the chemical supply stream in close proximity to the subsea tank. More than one of these sensors may be utilized in a single system to first trigger an alarm resulting in a slow-down of filling rate and at a higher pressure triggering shut-down.

According to other embodiments, disclosed herein are relief and safety mechanisms useful with the storage tank system. Products stored in seafloor tanks may have some degree of toxicity. As such, it may be desired to minimize a potential discharge to safely prevent catastrophic failure and complete discharge of the storage tank's chemical volume. This scenario may be accomplished by including a safety relief valve which both relieves excessively high pressures within the tank and alarms the situation to the refilling operations. These valves may be sized for relatively low transients and provide short term relief.

If the overfill pressure condition exceeds the relief valve capabilities, or the relief valve fails, a rupture disk may be utilized to prevent over-pressure and uncontrolled failure of the tank. These may also be used in series to provided 'staged' relief. Sensors placed on the rupture disks may alert operators to the condition.

The safety mechanism may also include a pre-determined, non-structural failure point in the event of un-manageable over-pressurization of the tank. The purpose of this intentional failure point is to protect the residual structural integrity of the tank system and equipment. Thus, it may be possible to recover the tank for post-event analysis.

The above discussion identifies three progressive levels of over-pressure protection. While only three methods are discussed, it is envisioned that more or fewer methods may also be used. The refill pressure strategies may apply whether the fill operations are performed on-shore, on a vessel, subsea through a riser or trickle charged through an umbilical.

In one or more embodiments, the unique aspects of this tank filling application may be that the tank is 100% liquid filled with seawater and chemicals in a high hydrostatic pressure environment. This approach offers several advantages to the more common pressure vessel storage. One advantage may be that storage tank wall thickness is reduced considerably in comparison with pressure vessel rated for depth, which may allow storage of large volumes of liquid within relatively light-weight tanks. The seawater and chemicals may be separated by a coated fabric bladder material. The working differential pressures may be small, such as between 5 and 15 psi, or such as between 8 and 12 psi, and pressure may rapidly change due to the high pressure environment.

Hydrostatic pressure can be taken advantage of by reducing the differential pressure requirements to move the liquid out of the tank to point of use or consumption. In some cases, taking advantage of the hydrostatic pressure may eliminate the need for a pump with the liquid output being metered or throttled by a valve controlled to the point of use or consumption.

In another embodiment disclosed herein, a permanent safety shut down system may be provided. A permanent safety shut down system may be fitted on each of the chemical holds within the shuttle. This system may include a pressure sensor on each tank which may be monitored by the process control system. When the internal tank pressure is high, the tank inlet safety valve may be closed to prevent more fluid and pressure within the tank.

Referring again to FIG. 1, the contamination sensor 131 and a differential pressure sensor 150 on each shuttle hold may operate an isolation valve 126 on the controlled opening 125 upon alarm conditions during refill operations.

In one or more embodiment disclosed herein, a multiplicity of tanks may be connected together using a shuttle chemical header and port. As described herein, the system comprises three tanks, but it is envisioned to comprise two, three, four, five, or more tanks. In some embodiments the system is envisioned to comprise ten, or twenty, or more tanks.

Figure 3:
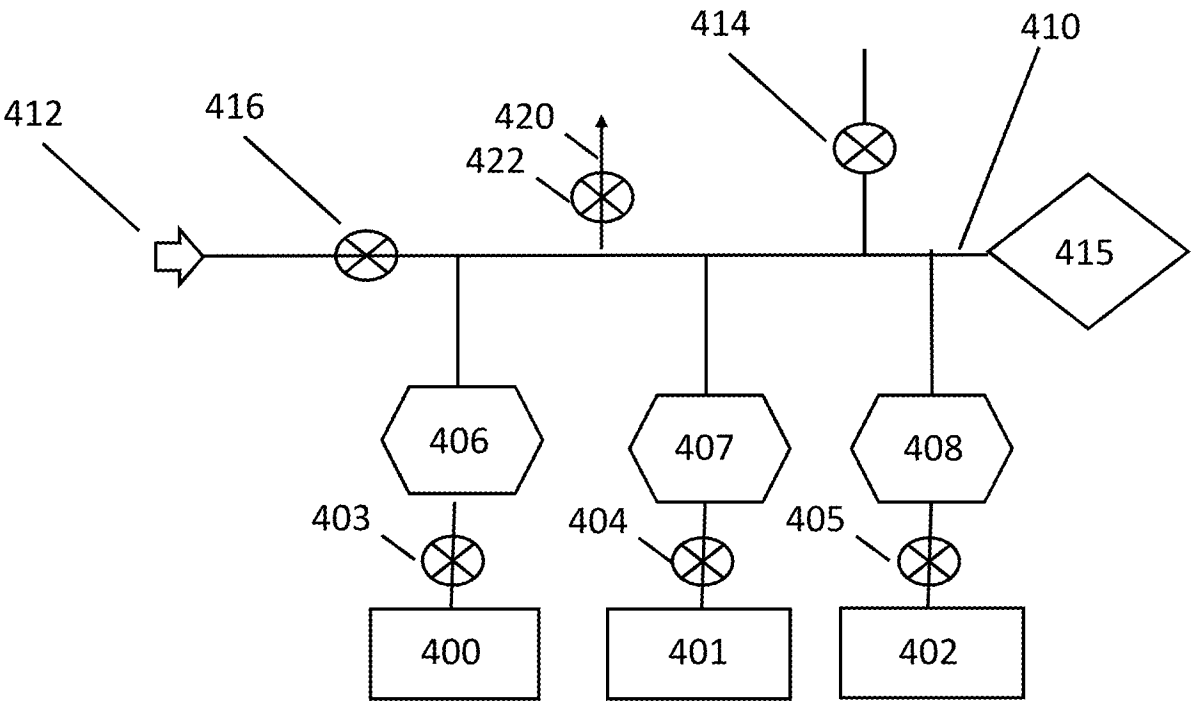
FIG. 3 shows a diagram of storage tank assembly containing a multiplicity of storage tanks according to embodiments disclosed herein.

Referring now to FIG. 3, tanks 400, 401, and 402 may be connected to a common header 410 as illustrated. In this embodiment, all chemical tank refill options may connect into the quick connect/disconnect (QCDC) attachment point 412. The header may also have a pressure relief valve 414 and a pressure transmitter 415 that may act as a back-up for the individual tank monitoring systems, as well as a header inlet isolation valve 416. This may provide pressure monitoring redundancy during any refill operation.

The shuttle's onboard chemical piping may be approximately 8 inch pipe, such as between 6 inch and 10 inch. Each of the chemical tanks 400, 401, and 402 may be fitted with isolation valves 403, 404, and 405, respectively, which are electrically controlled through the production control system. If the differential pressure gets too high or the contamination sensors on each tank detect a high chemical concentration in the seawater discharge during refill operations, then isolation valves 403, 404, or 405 may be closed.

If the alarm is from one of the contamination sensors on the tanks, then the sea water isolation valves on the tanks (illustrated in FIG. 1) may be closed, as well as isolation valves 403, 404, and 405, to contain any potential chemical leak. An ROV may collect a barrier fluid sample from the shut-in tank which may confirm the high concentration or it may indicate failure of the contamination sensor. Should the contamination sensor fail, a secondary contamination sensor could be deployed by ROV to the sea water outlet to monitor for contamination during a refill operation.

In series with the isolation valves 403, 404, and 405 may be flowmeters 406, 407, and 408 that may measure flow both into and out of the respective tanks. The tanks may all connect to the chemical header through this valve, flowmeter and piping link. The chemical header may include a pressure relief valve 414 as an additional level of safety. The shuttle tank is designed to have a differential pressure of between 5 and 15 psi, such as between 8 and 12 psi. The tank isolation safety valves 403, 404, and 405 may close automatically if an alarm pressure is detected. If the isolation valves do not close, then the relief valve 414 venting to the sea may open at about a 14 to 15 psi differential pressure between the chemicals in the header and the external hydrostatic pressure. This controlled chemical discharge to the sea may be done to protect the structural integrity of the shuttle holds and potential total loss of on-board chemical.

Also attached to the header may be a chemical hose 420 that transfers the chemical from the header 410 into the subsea chemical injection unit (SCIU). This hose connection may be remotely (ROV) released in the event the SCIU must be separately recovered to the surface. Chemical hose 420 may also have a separate, redundant isolation valve 422.

The safe liquid filling of a subsea low pressure tank as disclosed above not only applies to production chemicals as developed previously, but may also apply to large subsea oil storage tanks, and other subsea liquid storage needs.

Unlike subsea operations, time for refilling the chemical tanks in port may not be a significant factor. However, the safe operation of the filling process should still be observed. The refill operation may start with a proper grounding of all chemical handling equipment to manage any static electricity risk and a thorough inspection of system with any planned maintenance, equipment upgrades and or repairs conducted. A process control panel and electric supply may be required to test and monitor the shuttle's sensors (level and differential pressures) and operate all safety and isolation valves.

Figure 4:
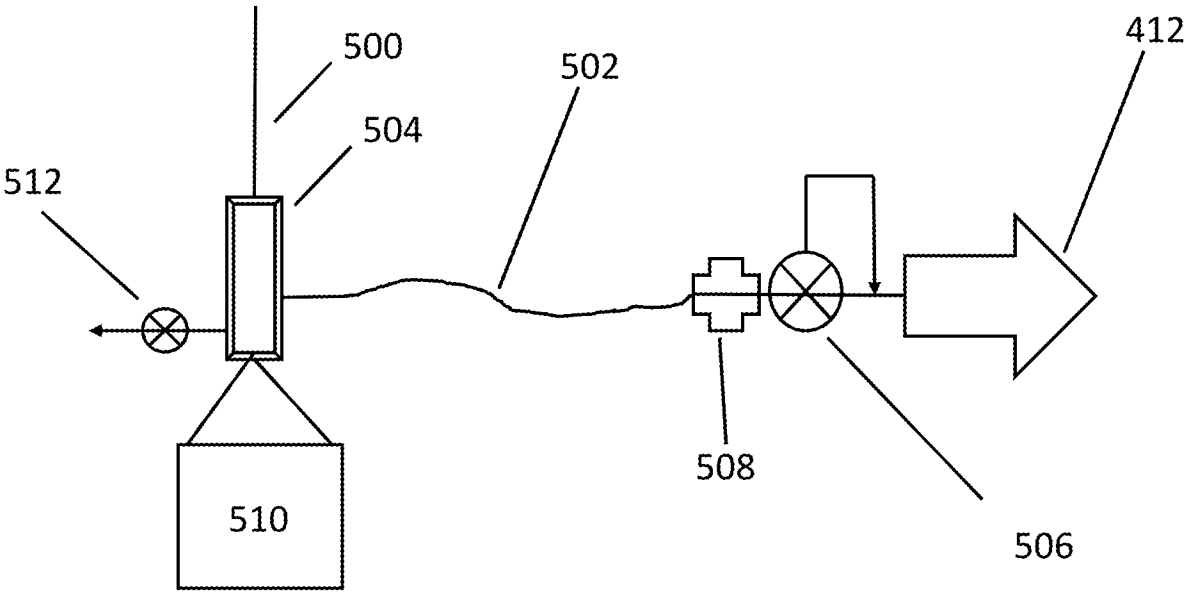
FIG. 4 shows a diagram of a riser assembly according to embodiments disclosed herein.

Referring now to FIG. 4, a downline 500 may be connected to the QCDC connection point 412. The chemical supply may be connected through downline 500 and the QCDC connection point 412 to the shuttle's piping. The supply pressure should be low pressure (below 10 psig) and capable of being dead-headed.

Samples of the seawater discharged during refilling operations may be collected and analyzed for comparison and calibration of the on-board contamination sensor. Additionally, because the shuttle is working in the offshore economic zone, discharge of the non-polluted seawater in port would be in compliance with regulatory requirements.

In one or more embodiments, a dynamically positioned multi-service vessel (MSV) equipped with a downline 500 and handling system (jointed tubing, hoses or coiled tubing) 502, an ROV may be used to resupply an in-situ shuttle on the seafloor with 3,000 bbls of chemical, or more. For such a scenario, the total pumping time may be 10 hours or less for up to 3,000 bbls of chemical (300 bbls per hour; 5 bbls per minute or ~210 gpm pumping rate). A riser pipe with a diameter of 3-5 inches may be used to handle these chemical flowrates. Near the shuttle, the piping may increase in diameter both to improve the piping strength but also to reduce the fluid velocity for more sensitive and precise pressure control within the shuttle's bladders during shuttle refilling.

FIG. 4 illustrates using a downline 500 (which may be in the form of a jointed riser) for the chemical supply connection between a surface vessel (ship) and the shuttle piping system. It may also be possible to use hoses or coiled tubing for this function as they may be deployed from the ship already chemical filled. As illustrated, as part of a lower riser assembly, the downline 500 is some form of jointed pipe that may be run wet and full of seawater. However, the handling system 502 from the sliding sleeve valve 504 to the QCDC connection point 412 may be run filled with chemical. The following description lists the basic features expected from each of the major components in the lower riser assembly.

The QCDC connection point 412 attaches the handling system 502 to the shuttle piping for chemical resupply. Each side of this connection may feature isolation valves which close both sides of the coupling upon its separation with minimum seawater ingestion. This coupling may be about 6 to 10 inches in size, such as 8 inches, and designed to operate at low differential pressures (about 50 psi).

The QCDC isolation valves may be pressure operated and pressure sensitive. That is, they may be designed to separate sufficiently far to close and seal pressure in the event the internal piping pressure exceeds a safe set-point. This set-point may be spring loaded and would recluse the QCDC when the internal pressures drop back into the safe operating range. Further, the QCDC may have an ROV visible indicator of the isolation valve positions. This is an additional safety feature that can be added to a standard QCDC.

A pressure control valve (PCV) 506 may throttle the pressure down to less than 10 psi for flow into the shuttles bladder chemical storage tanks. The piping and hoses may be sized to have bladder pressure and the PCV sensing point in the QCDC essentially equal for safe chemical supply. This PCV may be the primary pressure control to ensure the bladder remains within a safe operating range. Should this PCV require some external power to operate, it may be possible to provide batteries. This may enable the lower riser assembly to function independently without a separate power line or connection.

A break-away fitting 508 may be provided for protection from snag or any uncontrolled surface vessel drive-off. The connection may be robust and provide a predetermined point of failure to protect the shuttle components.

The handling system 502 may be used to connect between the shuttle and the riser. It may isolate the shuttle piping system from riser loads. This hose may routinely be chemical filled during riser running operations even if the riser is filled with seawater. The chemical may be captured between the QCDC connection point 412 and the sliding sleeve valve 504 at the lower end of the riser. The hose may have sufficient flexure to compensate for chemical pressure compensation (rather than leaking seawater through the (QCDC isolation valve.) Fluid swivels may also be included at each end of the hose (not illustrated).

In its running position the sliding sleeve valve 504 may be held in an "up" position where the sleeve ports connect the internal riser space with the external environment through an ROV operated isolation valve 512 (normally open). Once the riser is run in place and full of seawater, a batching ball may be launched from the surface ship down the riser. This ball is pushed down riser with the production chemical. While the ball is traveling down riser it may function as a batching pig and the riser's internal seawater is swabbed out and discharged to the sea through the porting in the sliding sleeve.

Once the ball reaches the sliding sleeve, it seats within the sleeve (sealing off the discharge port to sea) and the pressure build-up within the riser forces the sleeve into its "down" position. In the down position the sliding sleeve opens the secondary ports to the chemical hose and provides secondary sealing for the discharge port.

The downline 500 may need to be emptied of chemical before recovery onto the surface support vessel. By tracking the volume of chemical placed in the shuttle bladders, the supply operation may be stopped before 100% full. With margin for the amount of chemical within the riser, a second ball/batching pig may be launched into the riser. This second ball is pumped down riser using seawater while the residual chemical is pushed into the shuttle's chemical bladders. Once the ball seats in its respective seat in the sliding sleeve, it seals off the ports to the hose and shuttle. Thus, the riser is now water filled and ready to be recovered.

The downline 500 may be run from the MSV and has access to the chemical either onboard or from a separate transport vessel. The riser may be tensioned between a lower end clump weight 510 and the top riser assembly. The top riser assembly may be equipped with a master safety valve in the vertical riser run and a wing valve to a chemical transfer pump. The wing valve is attached to the ball/batching pig launcher on top of the riser. This launcher may have capacity for at least two pigs that may be independently launched.

A variable speed transfer pump (not illustrated) may be connected to either a chemical storage tank or it may be connected to a seawater supply for swabbing out the riser between chemical and seawater fill. The pump may have a bypass valve to discharge back into the supply tank in the event a valve is closed or the system cannot accept further fluids. A master safety valve may be closed by an operator on the ship or by signal/command from the host facility that is monitoring the refill operations through the permanent process control system.

In yet another embodiment disclosed herein is an effective chemical supply method that may be useful for applications requiring rapid batch chemical treatment. For example when injecting methanol into wells during shut-in operations to prevent hydrate formation. Most umbilical pipes are not large enough to supply the desired injection rate. Using the shuttle storage tanks as a buffer, surge or day tank and using subsea injection pumps to supply a high rate of chemical injection, rapid preservation of the production system may be possible.

Using a conventional umbilical termination assembly (UTA) typically deployed near subsea wells, it may be possible to charge the subsea storage tanks for rapid batch treatment. In such a scenario, the tubulars within the umbilical have a limited but continuous flow capacity which diminishes significantly with distance and chemical viscosity. This chemical flow may be redirected at the UTA into a chemical supply hose to the shuttle QCDC connection through a break-away fitting and a pressure control valve configured to limit the downstream pressure during refilling, similar to the riser scenario. The valve may limit over-filling and over-pressurization of the shuttle tanks. The onboard shuttle piping and safety systems are common to the other shuttle refill applications.

One difference of this trickle feed, from other filling operations, is that the components comprising the system may be downsized to better fit the slow flow rates through the umbilical. The host chemical supply may require changing from an injection mode of operation to one of interruptible continuous chemical supply.

Figure 5:
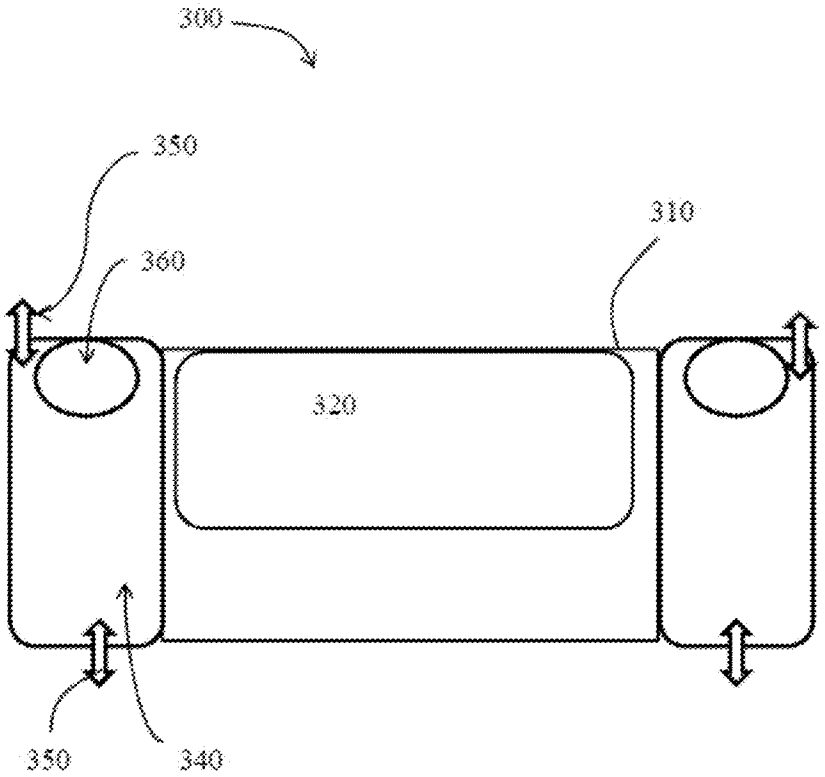
FIG. 5 shows a diagram of a storage tank according to embodiments of the present disclosure.

According to embodiments of the present disclosure, a method of providing a storage tank to the sea floor may include lowering the storage tank to the sea floor using at least one variable buoyancy chamber disposed along at least one wall of the storage tank. For example, referring to FIG. 5, a storage tank 300 according to embodiments of the present disclosure may include an outer container 310, at least one flexible inner container 320 disposed within the outer container 310, a balance assembly (not shown), similar to that described in FIG. 1, such as disposed on the outer container 310, and at least one variable buoyancy chamber 340 disposed along at least one wall of the outer container 310, wherein each variable buoyancy chamber 340 has at least one inflow outflow valve 350. In some embodiments, at least one variable buoyancy chamber may be disposed along a topside of the outer container of a storage tank, wherein the at least one variable buoyancy chamber is filled with pressurized air. The storage tank may then be lowered to the sea floor by releasing pressurized air from the variable buoyancy chamber and flowing seawater through the at least one inflow outflow valve into the variable buoyancy chamber. According to embodiments of the present disclosure, a storage tank 300 may also include at least one fixed buoyancy chamber 360. The at least one fixed buoyancy chamber 360 may be rated for the hydrostatic working depth of the storage tank 300. The amount of fixed buoyancy, e.g., the relative volume of the at least one fixed buoyancy chamber 360 to the storage tank 300, may control the submerged weight in the lowering line processes. Alternatively, in embodiments where the fluid in storage tank 300 has a low specific gravity, ballast may be used. The ballast overcome the buoyancy of the low specific gravity fluids during installation, and may be separately recovered to adjust the total weight of the structure within range of the fixed buoyancy during the structure recovery operations.

During a lowering operation, the balance assembly, comprising an isolation valve, a check valve, and a flexible bladder, has both the isolation and check valves in the open position to allow for the inflow of seawater into the space between the at least one inner container and the outer container. The inflow of seawater allows for the maintenance of the hydrostatic pressure on the at least one inner container.

During raising operation, the balance assembly has the isolation valve closed. As the hydrostatic pressure is decreased on the at least one inner container, the internal fluid will expand, the fluid will flow into the flexible bladder contained in the balance assembly. The flexible bladder may be sized to contain at least the maximum expansion of the internal fluid. In some embodiments, the flexible bladder may be sized to contain up to 10 barrels. In other embodiments, the flexible bladder may be sized to contain up to 13 barrels. In other embodiments, the flexible bladder may be sized to contain up to 15 barrels or more.

According to one or more embodiments disclosed herein is a method for retrofitting an existing storage tank. The existing storage tank may contain one or more rigid outer containers, at least one outlet, at least one inlet, and other associated piping, valves, control equipment, and anchoring devices. The existing storage tank may optionally contain one or more flexible inner containers and a fluid disposed within an space between the one or more outer containers and the one or more inner containers. The process of retrofitting may involve removing the at least one inlet and adding a balance assembly. The balance assembly may contain an inlet; an assembly connection point; an isolation valve located proximate the inlet, a flexible bladder located proximate the assembly connection point, and a check valve located intermediate of the isolation valve and the check valve. The balance assembly may also be installed just prior to recovery operations. The retrofitted tank may have improved performance in handling a change in hydrostatic pressure during lowering, dosing, and raising operations as compared to the tank without the balance assembly.

Further, storage tanks of the present disclosure may be floated at the surface of the sea for towing to and from the shore. For example, according to embodiments of the present disclosure, a storage tank may be larger than 3,000 barrels, larger than 5,000 barrels in some embodiments, and larger than 8,000 barrels in yet other embodiments. The storage tank may contain volumes in the disclosed ranges using either a single flexible inner container, or multiple flexible inner containers connected together in series or in parallel to achieve the desired total working volume. Further, as described above, a storage tank of the present disclosure may include one rigid outer container (holding at least one flexible inner container) or multiple rigid outer containers (each holding at least one flexible inner container) connected to each other. The total volume of the storage tank (including the rigid outer container and at least one flexible inner container) may range from greater than 3,000 barrels to a volume small enough to fit under a hoisting device and/or small enough for ROVs to maneuver the structure into its desired location on the seafloor. Such storage tanks may also have a high weight, and thus, support vessels may have inadequate crane capacity to lift the storage tank into or from the water. According to embodiments of the present disclosure, the storage tank may be hoisted towards the surface of the sea from the sea floor by releasing the water from the buoyancy chambers to float the storage tank or removing ballast to the adjust the storage tank's weight to buoyancy ratio.

According to embodiments of the present disclosure, a storage tank may be shaped to act as a barge or other seaborne vessel with an internal cargo hold containing at least one flexible inner container. The storage tank may include a bow for towing and/or double-sided walls and bottom to minimize consequences if a collision occurs during towing. Double-sided walls of a storage tank may also be used for buoyancy in floating the storage tank during towing and transit, which may subsequently be flooded when the tank is fully submersed. Further, in some embodiments, a storage tank shaped as a seaborne vessel may be subdivided into smaller compartments for containing and segregating multiple flexible inner containers filled with at least one type of chemical or for greater chemical storage volume.

The amount of rigging used to transition from a storage tank towing bridle to a rigging used to lower the storage tank to the seafloor on an active heave compensated lift line may be minimized. For example, a hinged towing bridle may be used at the bow of a storage tank. In some embodiments, a post may be braced at the center of a storage tank wherein the post has a connection profile on top of the post (at the end most distal from the storage tank) for a rapid connect/ROV release connector for attachment of the lifting line suspended from a workboat. A towing vessel may pull the storage tank alongside the workboat (i.e., a two vessel operation), wherein the attachment is to the top of the post for tank submergence and lowering to the seafloor.

As discussed above, high pressure buoyancy may be disposed along the topside of a storage tank according to embodiments of the present disclosure. By adding buoyancy chambers along the topside of a storage tank, the buoyancy may be provided above the center of gravity of the storage tank, and thus, the load may be stable when suspended from a lift line. The buoyancy chambers may reduce the submerged weight of the storage tank system such that a readily available crane or winch on a workboat with an ROV may be capable of lowering the tank to the seafloor, positioning and hooking up the storage tank system. The crane or winch used to maneuver the storage tank may be actively motion compensated to minimize the added mass loads due to the support vessel heaving. Buoyancy chambers may be provided in various forms. For example, fixed solid buoyancy rated for the working depth or a composite pipe capped and securely racked at the top of the storage tank may be used. The buoyancy pipe may be sized (diameter and wall thickness) to appropriately resist collapse pressures at the storage tank's operating depth while also providing the required amount of buoyancy. A buoyancy pipe may also be used as a compressed air, nitrogen, or other gas storage volume. For example, once a storage tank is lifted from the seafloor to a near-surface location (e.g., during a storage tank replacement operation) the air from the buoyancy pipe may be released into the variable buoyancy spaces within the structure of the storage tank to deballast these spaces and prepare the storage tank for surface towing. Using a fixed buoyancy pipe as compressed air storage may eliminate the need to connect an air hose or a water pump to deballast the sidewall tanks upon its return to surface.

Further, a storage tank may be fitted with piping and compartments to house and protect the chemical injection pump and meter components that route the chemicals (or other liquid other than seawater) through high pressure hoses or tubes to their injection points, as well as a balance assembly. In some embodiments, the injection pump, balance assembly, and related components may be returned with the storage tank, and thus may be routinely maintained along with the storage tank. In some embodiments, the injection pump, metering components, and the balance assembly may be separately located on a module that is independently maintained.

Depending upon the chemical dosing rate and the application, both the piping and injection pump may be appropriately sized, or if the chemical (or other liquid) is injected into a sub-hydrostatic environment, then a throttling valve and metering system may also be used. A control pod may control injection pumps and to monitor any sensors monitoring the operation of the storage tank and the metering system. The control pod may interface into the production control system using standard protocols. Further, a flying lead for power, data and command communications may be deployed from the storage tank to the subsea electrical connection point. The control pod, pump and metering system may be located onboard the storage tank or it may be separately positioned in the production system. Lockers for flying leads (both electrical and chemical) may be located on the storage tank, which may manage the flying leads during tank deployment and recovery. A locker may be optimized for ROV operation. A flying lead deployment mechanism may also facilitate the efficient recovery of flying leads in the event the storage tank is changed out.

Storage tanks of the present disclosure may be ballasted to sink below the surface of the sea, which in some cases, may include submersing the storage tank below waves at the sea surface. In some embodiments, while the storage tank is ballasted to sink below the surface of the sea, the isolation valve on the balance assembly may be in the open position to allow for compensation of hydrostatic pressure. According to some embodiments, columns may be attached to each corner of a storage tank. Columns may vary in size and shape, but may include, for example a height ranging from 10 to 35 feet. The columns may provide semisubmersible performance and motion control during ballast down operations until the tops of the columns submerge. Which may also provide for storage tank stability in the near surface wave environment.

Seafloor environments may vary, for example, the seafloor may be firm and compacted (on which a storage tank may be directly placed), or the seafloor may be soft (on which a storage tank may be placed on an intermediate foundation placed on the seafloor, such as a concrete mudmat). According to embodiments of the present disclosure, a suction pile foundation may be installed on the seafloor and then a storage tank of the present disclosure may be placed on the suction pile foundation. A suction pile foundation may provide hard spot landing points that are suitably reinforced to support the weight of the storage tank system. A foundation may also feature alignment posts (e.g., having at least two different heights) to capture matching funnels and sleeves built into a storage tank. The posts and funnels may assure proper location, alignment and orientation of the storage tank with respect to the rest of the subsea production system and equipment. A storage tank of the present disclosure may be maneuvered using a combination of the surface vessel positioning and the monitoring and maneuvering provided by at least one ROV. Further, there may be some constraints imposed by higher seafloor currents (and available ROV power), and thus, landing the storage tank may depend upon performing the operation during the cyclic low current time periods.

According to some embodiments, a skirt may be added to the bottom side of the storage tank to prevent its shifting. The skirt may be segregated into sections with piping to the topside of the storage tank, which may enable an ROV to dock and pump water into the skirt spaces under the storage tank to minimize any suction loads as the storage tank is lifted from the seafloor during a change-out operation.

Additionally, according to one or more embodiments disclosed herein, during deployment operations, the storage tank may be lowered (or ballasted) to bring the object just below the surface such that the attached buoyancy maintains a net positive buoyancy. Two or more vessels may then pay out a predetermined amount of weighted cable, or catenary cable, to overcome the attached buoyancy and submerge the storage tank. In this manner the package may be deployed close to the seafloor by the vessels. Finally, the equipment package will be landed on the seafloor by either removing or de-ballasting the attached buoyancy of the object, or by adding weight to the equipment package sufficient to counteract any positive buoyancy.

In such embodiments, large subsea packages may be deployed and recovered in a manner such as identified in U.S. Patent Application Publication No. 2016/0059943, incorporated herein by reference. The storage tank structure may support a payload of up to approximately 600 tons of chemicals that are lowered and positioned on the seafloor in a controlled manner, such as by the use of variable buoyancy and/or weighted cable. Cable may be attached from a plurality of vessels. Two, three, or more vessels may be used. The cable is attached to individual landing points on the storage tank from each vessel. A predetermined amount the weighted cable is payed out from the plurality of vessels. Buoyancy of the subsea equipment package is adjusted to sink the subsea equipment package to just below the sea surface. The subsea equipment package is positioned into its seafloor installation location as the subsea equipment package sinks toward a sea floor. Finally, the subsea equipment package is landed on the sea floor and installed.

The storage tank structure may also be deployed on, or be in the form of, a barge-like structure according to embodiments disclosed herein. The barge-like structure may float on the sea surface, and may be equipped with at least one buoyancy chamber. The barge-like structure may act as a structural foundation for the support and operation of various seafloor equipment or other payload, such as the storage tank. It is possible that the entire package of equipment may be tested and commissioned on the surface prior to its deployment to the seafloor. The unique deployment capability incorporates an integrated payload foundation to improve reliability of the equipment, minimize seafloor based construction and provide an effective and efficient recovery method should the equipment malfunction or need to be recovered for repairs, maintenance or modification.

Although only a few example embodiments have been described in detail above, those skilled in the art will readily appreciate that many modifications are possible in the example embodiments without materially departing from embodiments disclosed herein. Accordingly, all such modifications are intended to be included within the scope of this disclosure as defined in the following claims.

What is claimed:

1. A method of filling a subsea liquid storage tank comprising:

providing the subsea liquid storage tank in a subsea environment, the subsea liquid storage tank comprising:

a rigid outer container;

at least one inner container disposed within the outer container, the at least one inner container being expandable and collapsible;

a balance assembly disposed on the outer container, the balance assembly further comprising one or more isolation valves, one or more check valves, a contamination sensor, and at least one flexible bladder intermediate the outer container and the one or more isolation and check valves;

a barrier fluid disposed in a space between the at least one inner container and the outer container;

wherein the volume of the outer container remains fixed, and the volume of the at least one inner container is variable;

fluidly connecting, via piping, a surface vessel or a host facility to the subsea liquid storage tank;

filling the subsea liquid storage tank with liquid from the surface vessel or the host facility;

while filling, pressure balancing the containers as the system is filled and as the at least one inner container is emptied, wherein the balance assembly is fluidly connecting the space between the at least one inner container and the outer container.

2. The method of claim 1, further comprising disconnecting the subsea liquid storage tank from the surface vessel or the host facility.

3. The method of claim 1, further comprising monitoring one or both of a volume and a pressure within the subsea liquid storage tank using one or more sensors.

4. The method of claim 1, further comprising collecting and testing the barrier fluid and seawater in the subsea liquid storage tank for chemical contamination.

5. The method of claim 1, further comprising closing an isolation valve when the associated inner container is emptied, thereby not subjecting the inner containers to potentially large differential pressures.

6. The method of claim 1, further comprising monitoring the conditions in the space between the outer container and at least one inner container, thereby checking for a failure of the at least one inner container.

7. The method of claim 1, further comprising controlling an amount of seawater leaving the outer container as the at least one inner container is filled.

8. The method of claim 1, further comprising at least one buoyancy chamber along the outer container, wherein the at least one buoyancy chamber comprises pressurized gas, and wherein the at least one inner container is pressure balanced.

* * * * *